US010669687B1

(12) United States Patent
Niroumand

(10) Patent No.: US 10,669,687 B1
(45) Date of Patent: Jun. 2, 2020

(54) SYSTEMS AND METHODS FOR CONSTRUCTING RETAINING WALL STRUCTURE AND WELL POINT IN GRANULAR SOILS UNDER GROUNDWATER LEVEL

(71) Applicant: Bahman Niroumand, Boushehr Port (IR)

(72) Inventor: Bahman Niroumand, Boushehr Port (IR)

( * ) Notice: Subject to any disclaimer, the term of this patent is extended or adjusted under 35 U.S.C. 154(b) by 0 days.

(21) Appl. No.: 16/402,988

(22) Filed: May 3, 2019

(51) Int. Cl.

| | |
|---|---|
| ***E02D 19/10*** | (2006.01) |
| ***E02D 3/10*** | (2006.01) |
| ***E02D 29/02*** | (2006.01) |
| ***E02D 7/28*** | (2006.01) |

(52) U.S. Cl.
CPC ..... *E02D 19/10* (2013.01); *E02D 3/10* (2013.01); *E02D 7/28* (2013.01); *E02D 29/02* (2013.01); *E02D 2220/00* (2013.01); *E02D 2250/003* (2013.01)

(58) Field of Classification Search
CPC ..... E02D 3/10; E02D 27/26; E02D 19/10
See application file for complete search history.

(56) References Cited

U.S. PATENT DOCUMENTS

| | | | | |
|---|---|---|---|---|
| 5,332,047 | A * | 7/1994 | Hignite | E02D 7/08 173/1 |
| 9,840,835 | B2 * | 12/2017 | Niroumand | E02D 1/00 |
| 2007/0077128 | A1 * | 4/2007 | Wissmann | E02D 3/046 405/232 |
| 2017/0058477 | A1 * | 3/2017 | Niroumand | E02D 3/08 |

* cited by examiner

*Primary Examiner* — Sean D Andrish

(57) ABSTRACT

The present invention discloses a system and method for constructing retaining wall structure and well point in granular soils under groundwater level. The system is configured to drain the excavated zone and stabilizes the soil slope wall especially in urban lands with granular soils and high groundwater level during construction process. The system is configured to enable installation of vertical beams and polyethylene grooved drainage pipes wrapped by geotextile for drainage in the boundaries of the desired land by using a hammering casing pipe system. The hammering casing pipe system comprises a casing to receive the vertical beam and the drainage pipe, a mandrel for inserting the casing to the target location without removal of soil in the casing, a hammer element for hammering the mandrel into the target location, and a steel shaft or an impact transmission shaft configured to transfer impact from the hammer element to the mandrel.

6 Claims, 10 Drawing Sheets

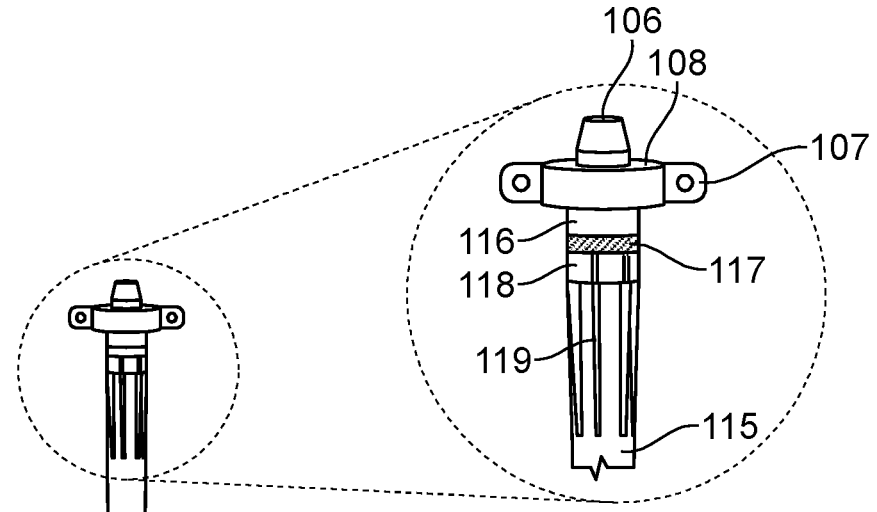
FIG. 1E
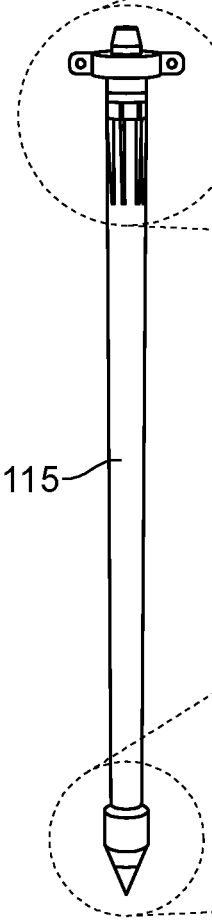
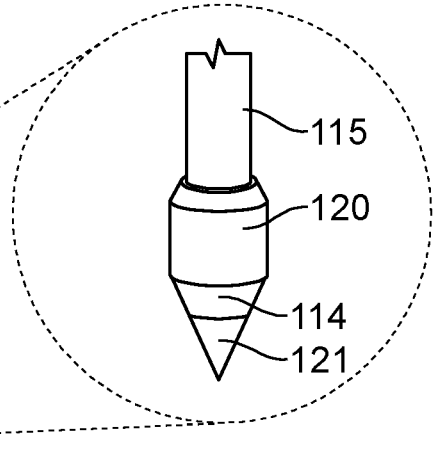
FIG. 1D
FIG. 1F

SYSTEMS AND METHODS FOR CONSTRUCTING RETAINING WALL STRUCTURE AND WELL POINT IN GRANULAR SOILS UNDER GROUNDWATER LEVEL

BACKGROUND OF THE INVENTION

In spite of the growth and development of the methods of soil walls stabilization of the excavated zone, the excavation and implementation retaining structures are one of the serious challenges for civil engineers in conditions, including in a) loose granular soils b) high groundwater level c) the existence of buildings and the passages overlooking the excavated zone d) the inefficiency and inadequacy of most of the methods for the soil wall stabilization for excavated zone with limited area and e) the high costs of conventional retaining structures. Hence, in some lands with a limited area that does not allow the use of bulky and heavy machinery or special methods of implementing the retaining structure, the stabilization of loose granular soil walls adheres to non-standard processes. Employing this type of process leads to financial losses for buildings, passageways and human casualties.

In general, to lower the groundwater level, two methods are used: (a) the implementation of the relief walls in excavated zone; and (b) the implementation of well points system in the boundaries of excavated zone. However, both methods are non-executable or not effective. Because, basically in submerged loose granular formations such as loose silty sand (SM), drilling and installation of concrete casing ring well with the required depth is hardly possible. Also, the level of the bottom of the well will raise decreasing the efficiency, and the presences of several relief wells in the excavated zone prevent any embankment operations and soil compaction.

However, the low depths of these wells lead to an increase in groundwater levels in the lower part of soil walls and their instability. The drainage well points system, despite having the effective performance of lowering the groundwater level, is not feasible due to (a) the lack of space on the top of excavation, (b) the existence intermediate hard layers in the range of effective depth.

On the other hand, in loose granular soils with high groundwater level, it is not possible for stepped excavation in range of 1-2 meters. Also, it is not possible to use and implement other methods of for soil walls stabilization in urban lands with limited areas such as; diaphragm walls, truss structures, sheet pile structures, piles, soil-cement columns and etc. Therefore, excavation and implementation of retaining structures in the conditions of loose granular soils and high groundwater level in urban plaques is still a serious challenge for most companies and civil engineers.

Existing prior art lack the ability to provide a system and method for constructing a retaining wall structure and a well point in granular soils under groundwater level. Thus, there is a need for a composite system and method for providing retaining wall structure and well points net with multi-stage construction process which is responsible to the drainage of the excavated zone and the stabilization of the soil slope wall, especially in urban lands with limited area and granular soils and with high groundwater level during the construction process.

SUMMARY OF THE INVENTION

A system and method for constructing retaining wall structure and well point in granular soils under groundwater level, is disclosed.

The system comprises a casing, an impact transmission shaft and an inner shaft. The casing with a hollow cylindrical configuration having a first end and a second end comprises at least two half-cylinders, a steel ring, one or more vertical stiffener plates, and at least one eye bar plate. At least two half-cylinders are attached around the upper end of the casing for hardening the upper end of the housing. The steel ring is disposed above the casing to harden and avoid bending of the casing. one or more vertical stiffener plates are attached around the steel ring and the at least two half-cylinders, and the at least one eye bar plate is disposed at each half-cylinder.

The steel shaft or impact transmission shaft comprises an upper portion and a lower portion. A hammer element is coupled to the upper portion of the steel shaft, wherein a diameter of the lower portion is greater than the upper portion. In one embodiment, the hammer element is at least one of a mechanical hammer element or a hydraulic hammer element. In another embodiment, the hammer element comprises at least two eye bar connections. Each eye bar connection comprises a strand link for moving the casing pipe and the inner shaft.

The inner shaft assembly is disposed within the casing, the inner shaft comprises a top portion, a middle portion and a bottom portion. The middle portion and the lower portion are configured to insert within the casing, into the soil and prevents soil entering into the casing.

The top portion of the inner shaft comprises a mandrel head configured to transmit impact from the hammer element, a stepped cylindrical segment extends from the mandrel head configured to maintain the position of the inner shaft, a lower cylindrical segment extends from the stepped cylindrical segment having a diameter lesser than the stepped cylindrical segment. The stepped cylindrical segment comprises at least two eye bar members for moving the inner shaft.

The middle portion of the inner shaft comprises at least six guide triangular plates disposed around the middle portion of the inner shaft and at least six connector plates coupled to the at least six guide triangular plates, respectively, wherein the at least six guide triangular plates and the at least six connector plates are coupled to the lower cylindrical segment via an intermediate segment.

The bottom portion of the inner shaft comprises a hollow cylindrical segment, a beveled hollow cylindrical segment extending from the hollow cylindrical segment, and a conical segment extending from the beveled hollow cylindrical segment configured to allow smooth penetration and prevention of soil entering into the casing pipe.

In one embodiment, a method for constructing a retaining wall structure and a well point in granular soils under groundwater level is disclosed. The method comprises a step of: providing a hammering casing piping system. The method further comprises a step of: positioning the mandrel above the target location. The method further comprises a step of: generating a cavity by driving the mandrel using an external hydraulic hammer. The method further comprises a step of: removing the inner shaft from the casing of the mandrel positioned in the cavity. The method further comprises a step of: providing a vertical beam and a drainage pipe fastened to the vertical beam. The method further comprises a step of: inserting the drainage pipe fastened to the vertical beam into the casing of the mandrel. The method further comprises a step of: removing the casing from the target location. The method further comprises a step of:

connecting the drainage pipe to a horizontal pipe connected with one or more water discharge pumps for lowering groundwater level.

The method further comprises a step of: installing a welded mesh behind the vertical beam and one or more layers of shotcrete layers on the target location. The method further comprises a step of: hammering a steel grooved pipe to a cross formed of a shotcrete layer and welded mesh, the hammering occurring at a target location under high frequency, wherein the steel grooved pipes comprises a conical end and shear connections. The method further comprises a step of: sealing the steel grooved pipe crossing the shotcrete layer and welded mesh. The method further comprises a step of: dewatering the target location using the drainage pipe and stabilizing the target location with the vertical beams and nailed steel grooved pipes.

In one embodiment, the steel grooved pipes comprise a conical end and shear connections. In one embodiment, the drainage pipe is polyethylene perforated drainage pipe. In one embodiment, an outer surface of the drainage pipe comprises a geotextile sheath. In one embodiment, a bottom end of the drainage pipe comprises a filter material. The method further comprises a step of: spraying geofoam over the geotextile sheath of the perforated polyethylene pipe in order to close all opening of perforated pipe after excavation.

One aspect of the present disclosure is directed to a hammering casing pipe system for forming a cavity at a target location, comprising: (a) a casing with a hollow cylindrical configuration having a first end and a second end comprising, at least two half-cylinders attached around the upper end of the casing for hardening the upper end, a steel ring disposed above the casing to harden and avoid bending of the casing, one or more vertical stiffener plates attached around the steel ring and the at least two half-cylinders, and at least one eye bar plate disposed at each half-cylinder; (b) an impact transmission shaft comprising an upper portion and a lower portion, a hammer element is coupled to the upper portion of the impact transmission shaft, wherein a diameter of the lower portion is greater than the upper portion, and (c) an inner shaft disposed within the casing, the inner shaft comprises a top portion, a middle portion and a bottom portion, the middle portion and the lower portion are configured to insert within the casing, into the soil and prevents soil entering into the casing, wherein the top portion of the inner shaft comprises a mandrel head configured to transmit impact from the hammer element, a stepped cylindrical segment extends from the mandrel head configured to maintain the position of the inner shaft, a lower cylindrical segment extends from the stepped cylindrical segment having a diameter lesser than the stepped cylindrical segment, wherein the middle portion of the inner shaft comprises at least six guide triangular plates disposed around the middle portion of the inner shaft and at least six connector plates coupled to the at least six guide triangular plates, respectively, wherein the at least six guide triangular plates and the at least six connector plates are coupled to the lower cylindrical segment via an intermediate segment, and wherein the bottom portion of the inner shaft comprises a hollow cylindrical segment, a bevelled hollow cylindrical segment extending from the hollow cylindrical segment, and a conical segment extending from the bevelled hollow cylindrical segment configured to allow smooth penetration and prevention of soil entering into the casing pipe.

In one embodiment, the hammer element is a mechanical hammer. In another embodiment, the hammer element is a hydraulic hammer. In one embodiment, the hammer element comprises at least two eye bar connections. In another embodiment, each eye bar connection comprises a strand link for moving the casing pipe and the inner shaft. In one embodiment, the stepped cylindrical segment comprises at least two eye bar members for moving the inner shaft.

Another aspect of the present disclosure is directed to a hammering casing pipe system for forming a cavity at a target location, comprising: (a) a casing with a hollow cylindrical configuration having a first end and a second end comprising, at least two half-cylinders attached around the upper end of the casing for hardening the upper end, a steel ring disposed above the casing to harden and avoid bending of the casing, one or more vertical stiffener plates attached around the steel ring and the at least two half-cylinders, and at least one eye bar plate disposed at each half-cylinder; (b) an impact transmission shaft coupled to a hammer element; (c) an inner shaft disposed within the casing, the inner shaft comprises a top portion, a middle portion and a bottom portion, the middle portion and the lower portion are configured to insert within the casing, into the soil and prevents soil entering into the casing, wherein the top portion of the inner shaft comprises a mandrel head configured to transmit impact from the hammer element, a stepped cylindrical segment extends from the mandrel head configured to maintain the position of the inner shaft, a lower cylindrical segment extends from the stepped cylindrical segment having a diameter lesser than the stepped cylindrical segment, wherein the middle portion of the inner shaft comprises at least six guide triangular plates disposed around the middle portion of the inner shaft and at least six connector plates coupled to the at least six guide triangular plates, respectively, wherein the at least six guide triangular plates and the at least six connector plates are coupled to the lower cylindrical segment via an intermediate segment, and wherein the bottom portion of the inner shaft comprises a hollow cylindrical segment, a bevelled hollow cylindrical segment extending from the hollow cylindrical segment, and a conical segment extending from the bevelled hollow cylindrical segment configured to allow smooth penetration and prevention of soil entering into the casing pipe. In one embodiment, the impact transmission shaft comprising an upper portion and a lower portion. In another embodiment, the diameter of the lower portion is greater than the upper portion.

Another aspect of the present disclosure is directed to a method for constructing retaining wall structure and well-point in granular soils under groundwater level, comprising the steps of: (a) providing a hammering casing pipe system comprising: a casing with a hollow cylindrical configuration having a first end and a second end comprising, at least two half-cylinders attached around the upper end of the casing for hardening the upper end, a steel ring disposed above the casing to harden and avoid bending of the casing, one or more vertical stiffener plates attached around the steel ring and the at least two half-cylinders, and at least one eye bar plate disposed at each half-cylinder; an impact transmission shaft coupled to a hammer element; and an inner shaft assembly disposed within the casing, the inner shaft comprises a top portion, a middle portion and a bottom portion, the middle portion and the lower portion are configured to insert within the casing, into the soil and prevents soil entering into the casing, wherein the top portion of the inner shaft comprises a mandrel head configured to transmit impact from the hammer element, a stepped cylindrical segment extends from the mandrel head configured to maintain the position of the inner shaft, a lower cylindrical segment extends from the stepped cylindrical segment having a diameter lesser than the stepped cylindrical segment, wherein the middle portion of the inner shaft comprises at least six guide triangular plates disposed around the middle portion of the inner shaft and at least six connector plates coupled to the at least six guide triangular plates, respectively, wherein the at least six guide triangular plates and the at least six connector plates are coupled to the lower cylindrical segment via an intermediate segment, and wherein the bottom portion of the inner shaft comprises a hollow cylindrical segment, a bevelled hollow cylindrical segment extending from the hollow cylindrical segment, and a conical segment extending from the bevelled hollow cylindrical segment configured to allow smooth penetration and prevention of soil entering into the casing pipe; (b) positioning the hammering casing pipe system above the target location; (c) generating a cavity by driving the casing using an external hammer element; (d) removing the inner shaft from the casing positioned in the cavity; (e) providing a vertical beam and a drainage pipe fastened to the vertical beam; (f) inserting the drainage pipe fastened to the vertical beam into the casing; (g) removing the casing from the target location; (h) connecting the drainage pipe to a horizontal pipe connected with one or more water discharge pumps for lowering groundwater level; (i) installing a welded mesh behind the vertical beam and one or more shotcrete layers on the target location; (j) hammering one or more steel grooved pipes to a cross formed of a shotcrete layer and welded mesh, the hammering occurring at a target location under high frequency; (k) sealing the steel grooved pipe crossing the shotcrete layer and welded mesh, and (l) dewatering the target location using the drainage pipe and stabilizing the target location with the vertical beams and nailed steel grooved pipes.

In one embodiment, the steel grooved pipes comprise a conical end and shear connections. In another embodiment, the drainage pipe is polyethylene perforated drainage pipe. In one embodiment, an outer surface of the drainage pipe comprises a geotextile sheath. In another embodiment, the method further comprises a step of spraying Geofoam over the geotextile sheath of the perforated polyethylene pipe in order to close all opening of perforated pipe after excavation. In a related embodiment, a bottom end of the drainage pipe comprises a filter material.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

FIG. 1D illustrates a mandrel for inserting the casing pipe into the ground without removal the soil inside the casing pipe, according to an embodiment of the present invention;

FIG. 1E illustrates an enlarged view of an upper section of the mandrel, according to an embodiment of the present invention;

FIG. 1F illustrates an enlarged view of a bottom section of the mandrel, according to an embodiment of the present invention;

DETAILED DESCRIPTION

Figures 1A, 1B, 1C:
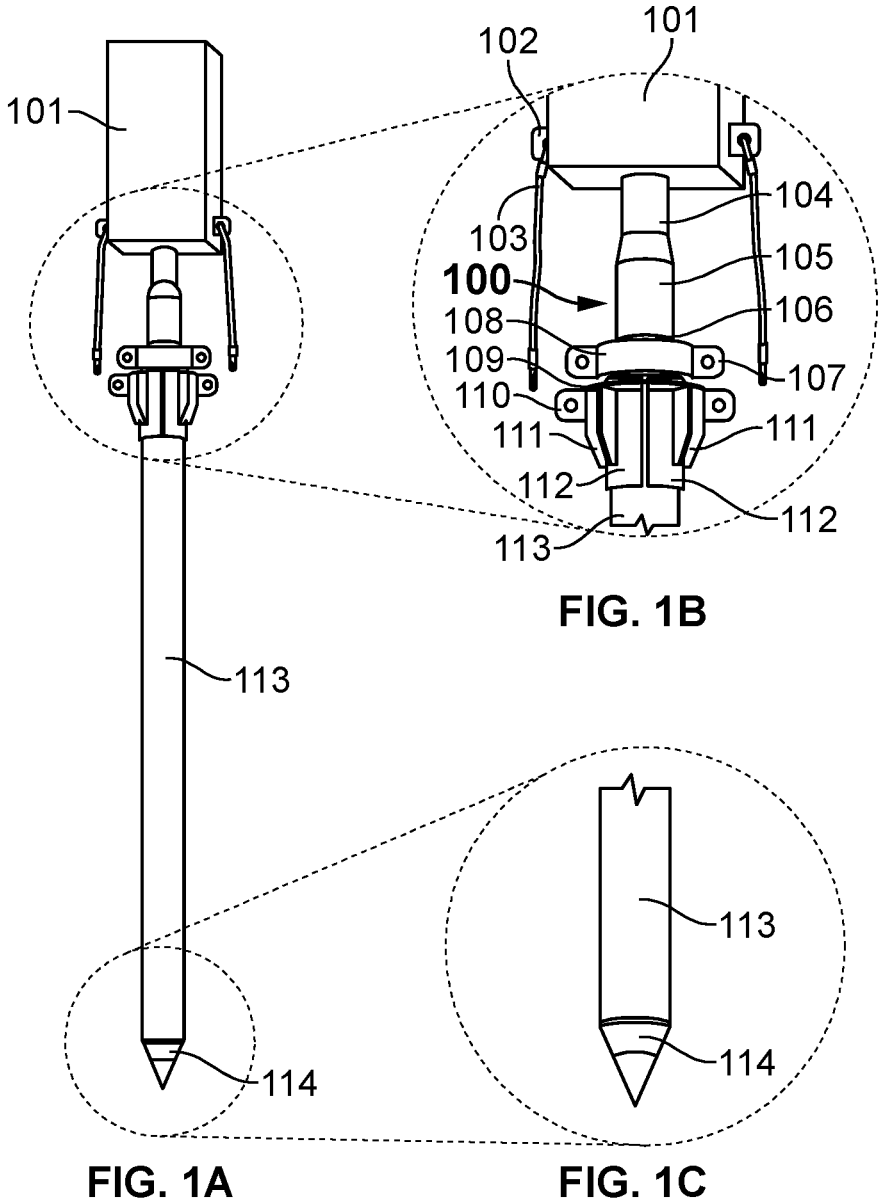
FIG. 1A illustrates a perspective view of a hammering casing pipe system, according to an embodiment of the present invention.
FIG. 1B illustrates an enlarged view of an upper section of the hammering casing pipe system, according to an embodiment of the present invention.
FIG. 1C illustrates an enlarged view of a bottom section of the hammering casing pipe system, according to an embodiment of the present invention.

The present invention generally relates to an excavation process, and more particularly relates to a system and method for constructing retaining wall structure and well point in granular soils under groundwater level.

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Referring to FIG. 1A to FIG. 1D, a hammering casing pipe system comprises a casing 113 configured to receive a vertical beam 123 and a drainage pipe 124, a mandrel or an inner shaft assembly 115 for inserting the casing 113 to the target location without removal of soil in the casing 113, a hammer element 101 for hammering the mandrel 115, a steel shaft or an impact transmission shaft configured to transfer impact from the hammer element 101 to the mandrel 115.

Referring to FIG. 1B, the casing 113 with a hollow cylindrical configuration comprises a first end and a second end. The casing pipe 113 is open-ended and the structure of the mandrel 115 is designed so that it does not require to removing the soil from the inside of the casing pipe 113. In order to cross the mandrel 115 through the hard soil layers, the upper end of the casing pipe 113 is stiffened using vertical stiffener plates 111. The first end of the casing 113 comprises at least two half-cylinders 112, a steel ring 109, one or more vertical stiffener plates 111, and at least one eye bar plate 110. At least two half-cylinders 112 are attached around the upper end of the casing 113 for hardening the upper end of the casing 113. The steel ring 109 disposed above the casing 113 to harden and avoid bending of the casing edge. One or more vertical stiffener plates 111 attached around the steel ring 109 and the at least two half-cylinders 112.

The steel shaft comprises an upper portion 104 and a lower portion 105 having a diameter greater than the upper portion 104. The hammer element 101 is coupled to the upper portion 104 of the steel shaft. At least two eye bar connections 102 are welded to the hammer element 101 for moving the inner shaft assembly 115 and casing 113. Each eye bar connection 102 comprises a strand link 103 for moving the inner shaft assembly 115 and casing 113. In one embodiment, the hammer element 101 is at least one of a hydraulic hammer or mechanical hammer.

FIG. 1C illustrates an enlarged view of a bottom section of the hammering casing pipe system, according to an embodiment of the present invention. FIG. 1C further illustrates a beveled hollow cylindrical segment 114 of the mandrel 115. FIG. 1D illustrates the mandrel 115 for inserting the casing pipe 113 into the ground or target location without removal the soil inside the casing pipe 113, according to an embodiment of the present invention.

Referring to FIG. 1B and FIG. 1E, the mandrel or inner shaft assembly 115 is disposed within the casing 113. The inner shaft assembly 115 comprises a top portion, a middle portion and a bottom portion. The middle portion and the lower portion are configured to insert within the casing 113, into the soil and prevents soil entering into the casing. The top portion of the inner shaft assembly 115 comprises a mandrel head 106, a stepped cylindrical segment 108 and a lower cylindrical segment 116. The mandrel head 106 is configured to transmit impact from the hydraulic hammer, the stepped cylindrical segment 108 extends from the mandrel head 106 is configured to maintain the position of the inner shaft assembly 115 and the lower cylindrical segment 116 extends from the stepped cylindrical segment 108, the lower cylindrical segment 116 have a diameter lesser than the stepped The stepped cylindrical segment 108 comprises at least two eye bar members 107 for moving the inner shaft assembly 115.

Referring to FIG. 1E, the middle portion of the inner shaft assembly 115 comprises at least six guide triangular plates 119 and at least six connector plates 118. The at least six guide triangular plates 119 are disposed around the middle portion of the inner shaft assembly 115. The at least six connector plates 118 coupled to the at least six guide triangular plates 119, respectively, wherein the at least six guide triangular plates 119 and the at least six connector plates 118 are coupled to the lower cylindrical segment 116 via an intermediate segment 117.

Referring to FIG. 1F, the bottom portion of the inner shaft assembly 115 comprises a hollow cylindrical segment 120, a beveled hollow cylindrical segment 114 extending from the hollow cylindrical segment 120 and a lower segment or a conical segment 121 extending from the beveled hollow cylindrical segment 114. The conical segment 121 is configured to allow smooth penetration and prevention of soil entering into the casing pipe 113.

Figure 1G:
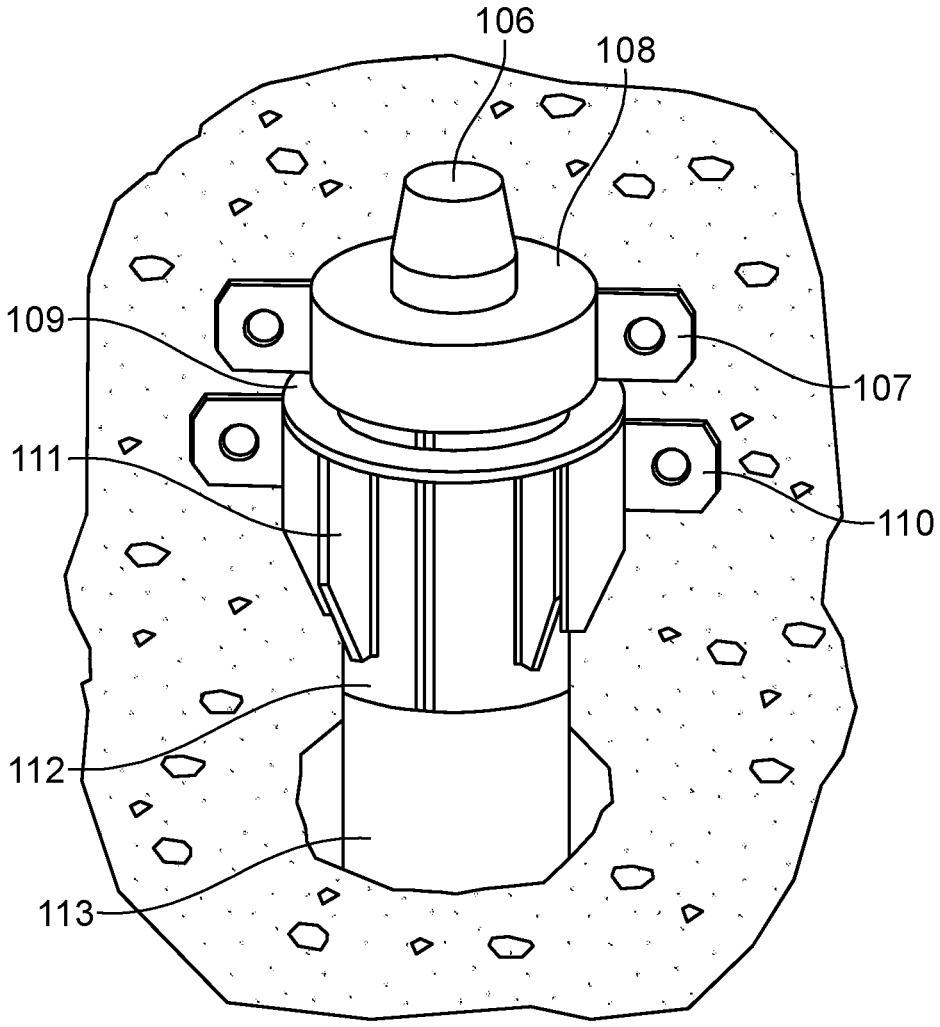
FIG. 1G illustrates a perspective view of an upper section of the mandrel and casing pipe at the final step of hammering process, according to an embodiment of the present invention.

In an embodiment, the lower segment 121 is of different configurations, for example, a conical configuration, a pyramidal configuration, etc. The different configurations or shapes of the lower segment 121 are used based on the requirements of the application. For example, in loose soils, a conical configuration is used and for medium density soils, a pyramidal configuration is used to generate the cavity in the soil. In another embodiment, the lower segment 121 is configured in a wedge shape to bore through hard rock surfaces. In an embodiment, the target location is, for example, a loose sandy soil, a clayey soil, a medium density soil, a hard rock soil bed, etc. FIG. 1G illustrates a perspective view of an upper section of the mandrel 115 and casing pipe 113 at the final step of hammering process, according to an embodiment of the present invention.

Figure 2:
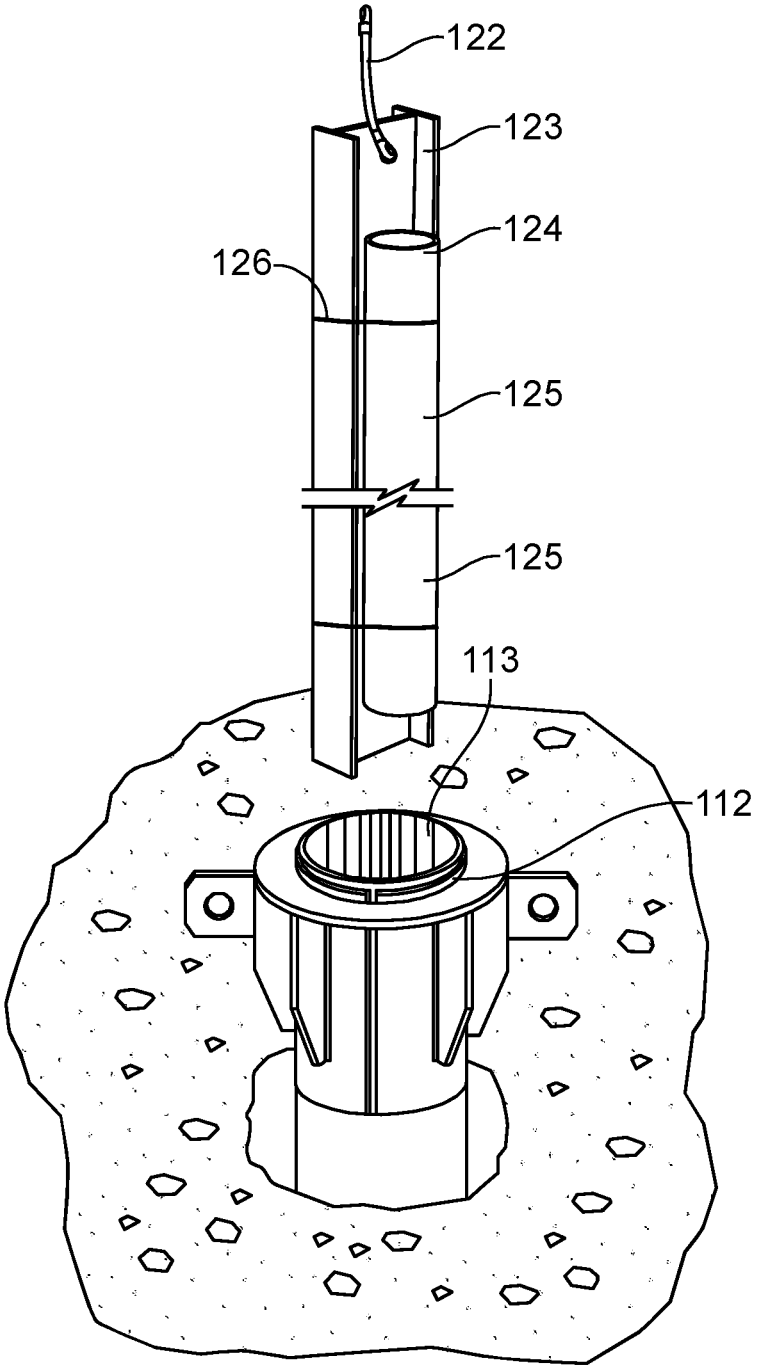
FIG. 2 illustrates a perspective view of the moment of inserting the vertical beam and drainage pipe into the casing pipe, according to an embodiment of the present invention.

FIG. 2 illustrates a perspective view of the moment of inserting a vertical beam 123 and a drainage pipe 124 into the casing pipe 113, according to an embodiment of the present invention. The drainage pipe 124 is fastened to the vertical beam 123 via one or more fasteners 126. In one embodiment, the drainage pipe 124 is a polyethylene perforated drainage pipe. In one embodiment, the vertical beam 123 is at least one of a I shaped beam or a H shaped beam. The outer surface of the drainage pipe 124 comprises a geotextile sheath. A strand link 122 is disposed at a top portion of the vertical beam 123 to move the casing pipe 113 fastened to the vertical beam 123.

Figures 3A, 3B, 3C:
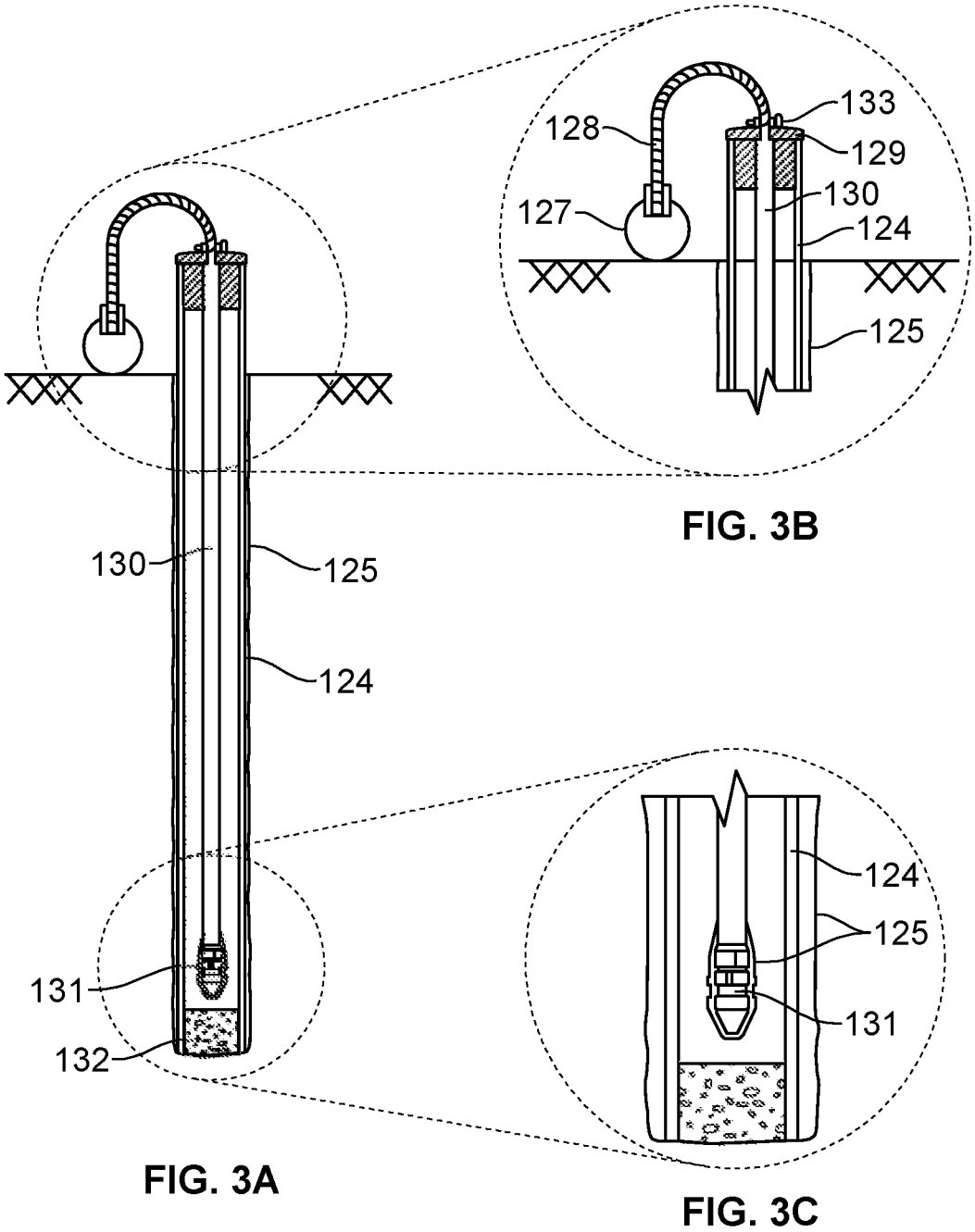
FIG. 3A illustrates a longitudinal section of a well point, according to an embodiment of the present invention.
FIG. 3B illustrates an enlarged view of an upper section of the well point, according to an embodiment of the present invention.
FIG. 3C illustrates an enlarged view of a bottom section of the well point, according to an embodiment of the present invention.

Referring to FIG. 3A-FIG. 3B, a longitudinal section of a well point comprises a drainage pipe 124, a gravel filter 132, a suction pipe or riser pipe 130, a plastic filter 131, a cap of drainage pipe 128, the plastic U-pipe 128, and the horizontal pipe or header pipe 127. Referring to FIG. 3B, a suction pipe 130 for removing the underground water is disposed within the drainage pipe 124. The cap 129 is disposed at an upper end of the drainage pipe 124, and a plastic U-shaped pipe 128 extends from the suction pipe 130 and coupled to the header pipe 127 for water collection. A one-way tap 133 is connected to the plastic U-shaped pipe 128 to control water absorption. Referring to FIG. 3C, a gravel filter 132 is disposed at the lower end of the drainage pipe 124 and a plastic filter 131 is disposed at a lower end of the riser pipe 130 to prevent absorption of fine aggregates.

Figure 4A:
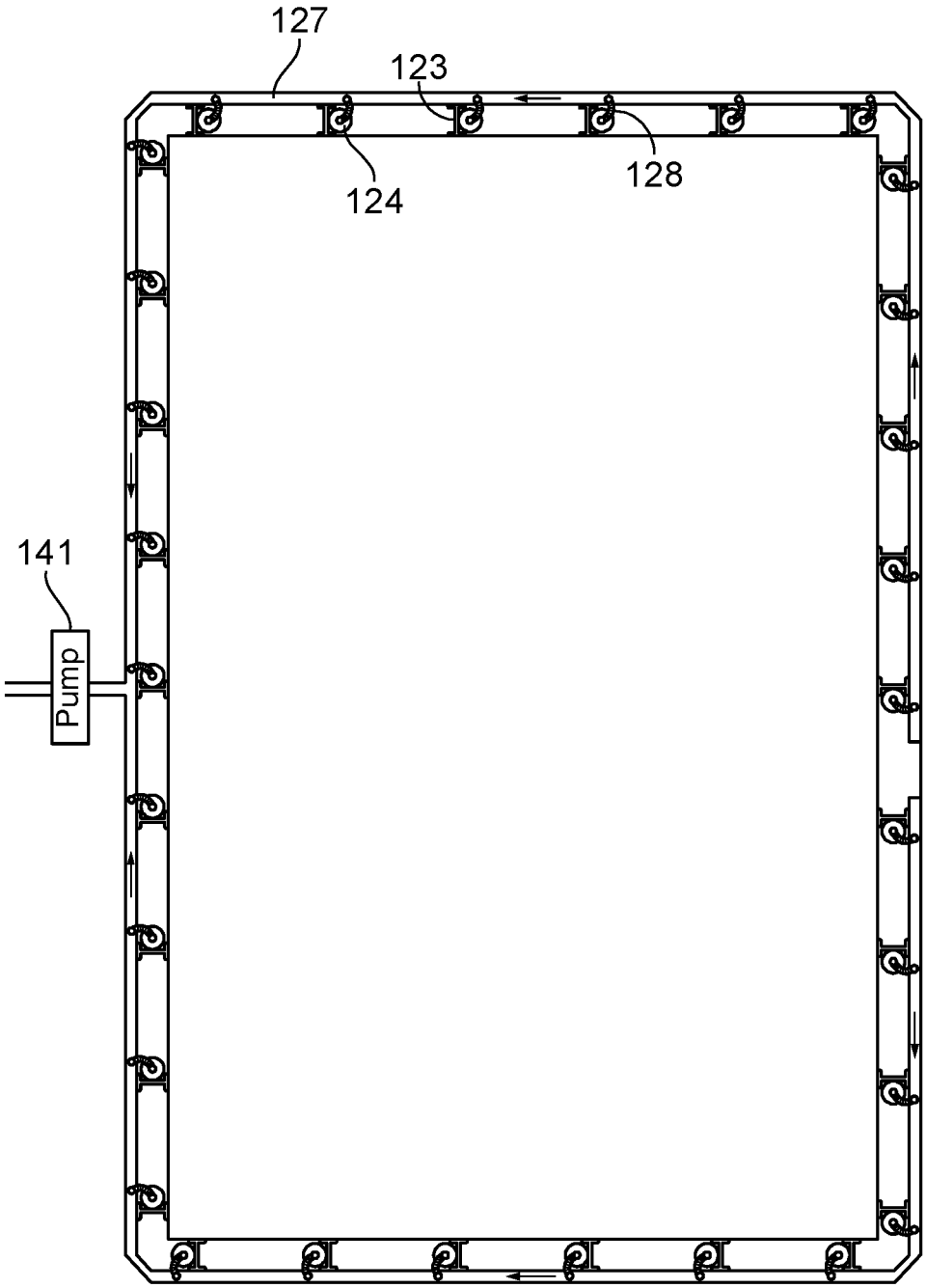
FIG. 4A illustrates an enlarged view of layout of the structural beams, well points, and a header pipe for water collection in the perimeter of the excavated zone, according to an embodiment of the present invention.
Figure 4B:
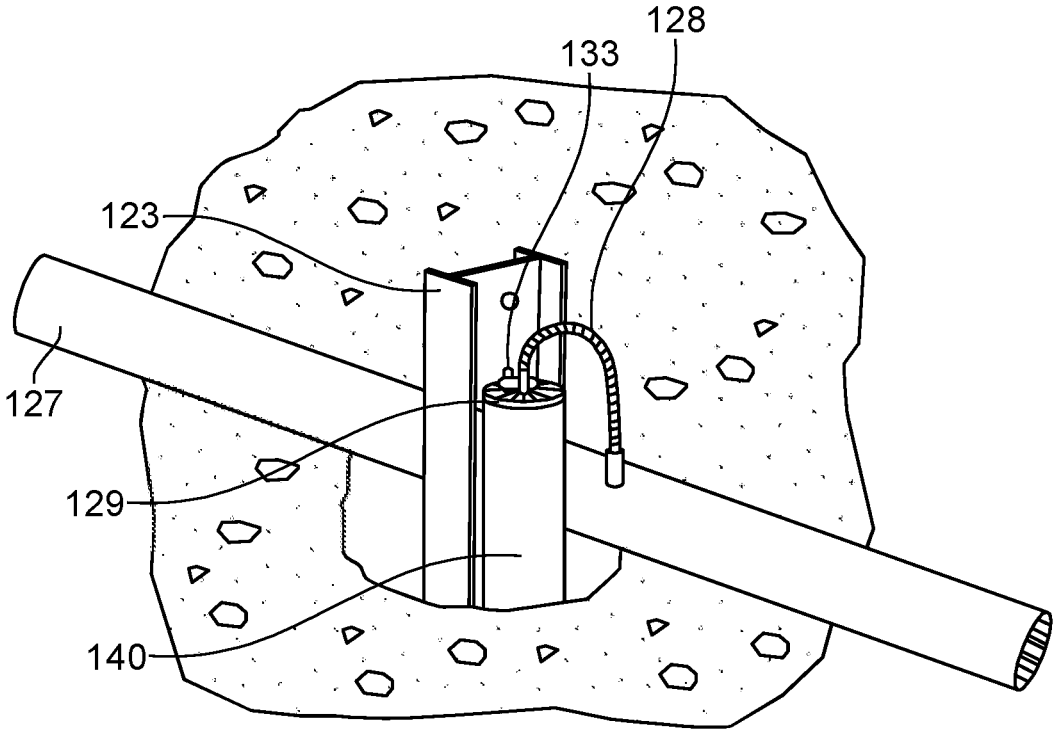
FIG. 4B illustrates a perspective view of an upper section of the well point, structural beam and header pipe for water collection, according to an embodiment of the present invention.

Referring to FIG. 4A, a plurality of drainage pipe 124 fastened to the vertical beam 123. Each drainage pipe 124 is connected to the header pipe 127 for water collection via a pump, such as motor pump 141. Referring to FIG. 4B, a perspective view of an upper section of a well point, structural beam 123 and the header pipe 127 for water collection, according to an implementation is disclosed.

In another embodiment, the present invention provides an excavation process to implement in a target location such as granular soils under groundwater level, homogenous sandy soils with high level groundwater, hard sandy soil Intermediate layer with high cementation and low permeability in the limited of effective depth of excavated zone i.e., 1.25-1.35 times the depth of excavation. Initially, the casing pipe 113 is driven into the ground. The steel beam 123 and drainage pipe 124 are guided simultaneously into the casing pipe 113. After the installation is complete, the casing pipe 113 is removed from the ground and free space between the wall and steel beam are filled with clean sand.

Then, the system of drainage wells is implemented and activated by installing vertical beams 123 in the wells and connecting the horizontal pipe or header pipe 127 collecting water at the top of the wells. The header pipes 127 are in communication with one or more water discharge pumps. In one embodiment, the drainage system is under vacuum. Based on this, all of the connection between drainage pipes 124 must be fastening and airtight. After installing the well points system, the groundwater level is lowered.

A welded mesh 134 and shotcrete layers 135 are installed behind the vertical beams 123. Then the steel vertical beams 123 are anchored through rammed-injected soil nailing. At each stage of columnar excavation, immediately after that, the pores of geotextile layer 125 by is blocked by spraying geofoam around this layer for prevention from suction drop in the well points system. Additionally, using a rammed-injected nailing system instead of conventional nails the vertical steel beams 123 will be tightened. In one embodiment, the rammed-injected soil nailing system consist of a steel pipe 136 with 76 mm external diameter and 68 mm internal diameter and a conic-shaped end. This pipe in 2-3-meter pieces will be hammered into the soil wall by a hammer that mounted on a mechanical excavator under the frequency impacts. Due to the possibility of injection of cement grout through these pipes 136, the end sections of the pipes 136 are perforated. Usually, the length of this section is equal to 50-75 cm. In this section, for the injection of cement slurry into the pipe, 16 holes of 8 mm in diameter, symmetrically separated, are required at the four sides of the pipe.

Also, in order to increase the tensile strength of these pipes 136, a number of shear connections 138 is installed on the pipe at the end of these pipes. These shear connections 138 increase the cross-sectional grout of the pipe 136 and further pipe interference with the cemented area 137 around the pipe 136, thereby increasing the tensile strength. Also, hammering the pipes 136 into the soil wall increases the compaction of the soil around the pipe 136 and improves tensile strength of anchor. In some cases, it is also possible to use simple or with shear connection pipes for soil nailing without cement injection.

Figure 5:
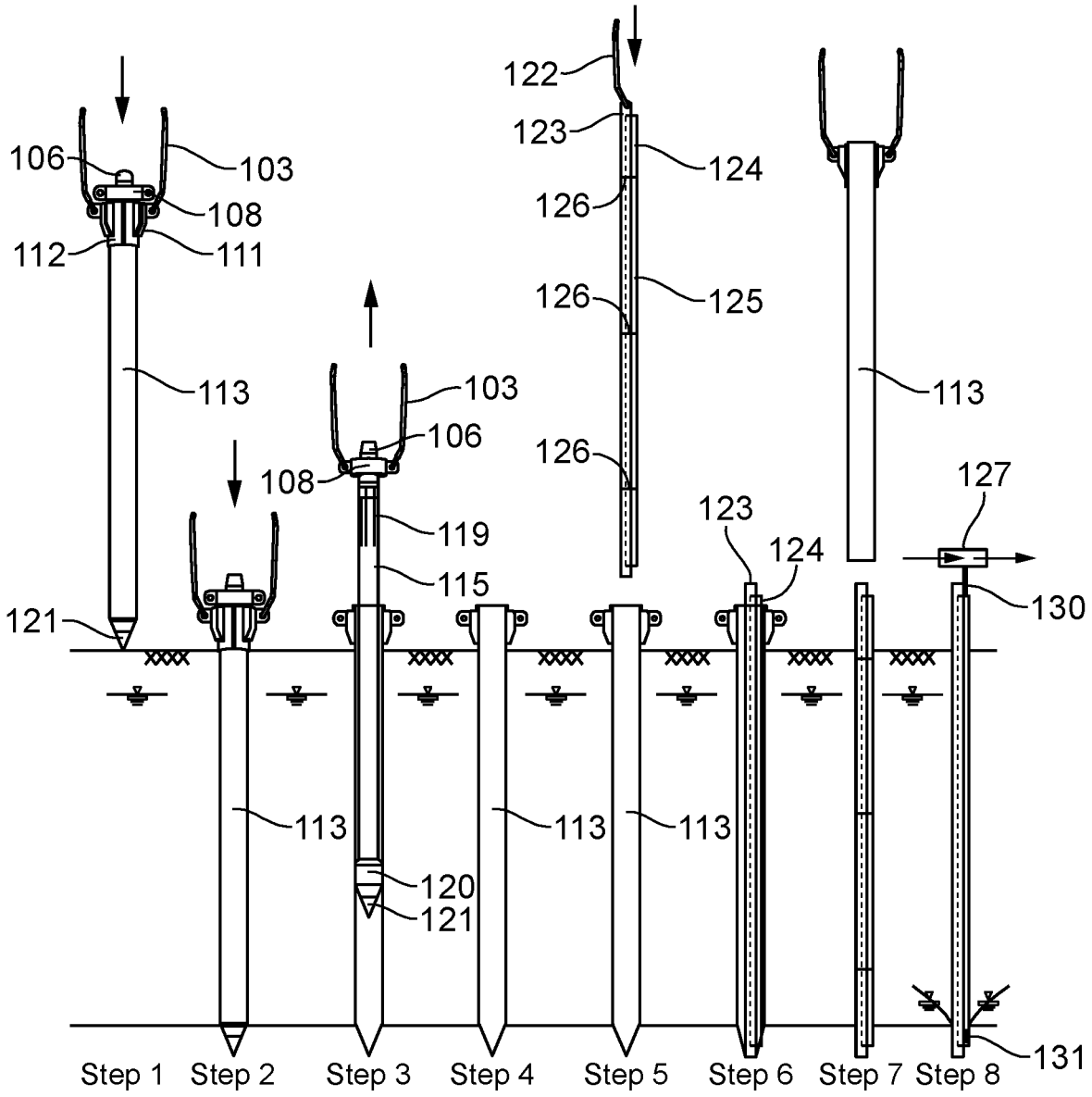
FIG. 5 illustrates schematic views of steps for installation of a vertical structural beam and building a well point in submerged loose granular soil, according to an embodiment of the present invention.

FIG. 5 illustrates schematic views of steps for installation of a vertical structural beam 123 and building a well point in submerged loose granular soil, according to an implementation. A mandrel 115 is positioned above the target location. A hammer element 101, for example, a mechanical or hydraulic hammer, hammers the mandrel 115 to the required depth as illustrated. The inner shaft assembly 115 fastened to the casing is then released. The inner shaft assembly 115 is removed from the casing 113. The drainage pipe 124 is fastened to the vertical beam 123 via one or more fasteners 126 is provided. The drainage pipe 124 is fastened to the vertical beam 123 is inserted into the casing 113. After insertion of the drainage pipe 124 at the length of the hammered mandrel 115, the casing 113 is finally removed from the target location. Then the drainage pipe 124 is coupled to the header pipe 127 for water collection to form the well point.

Figure 6:
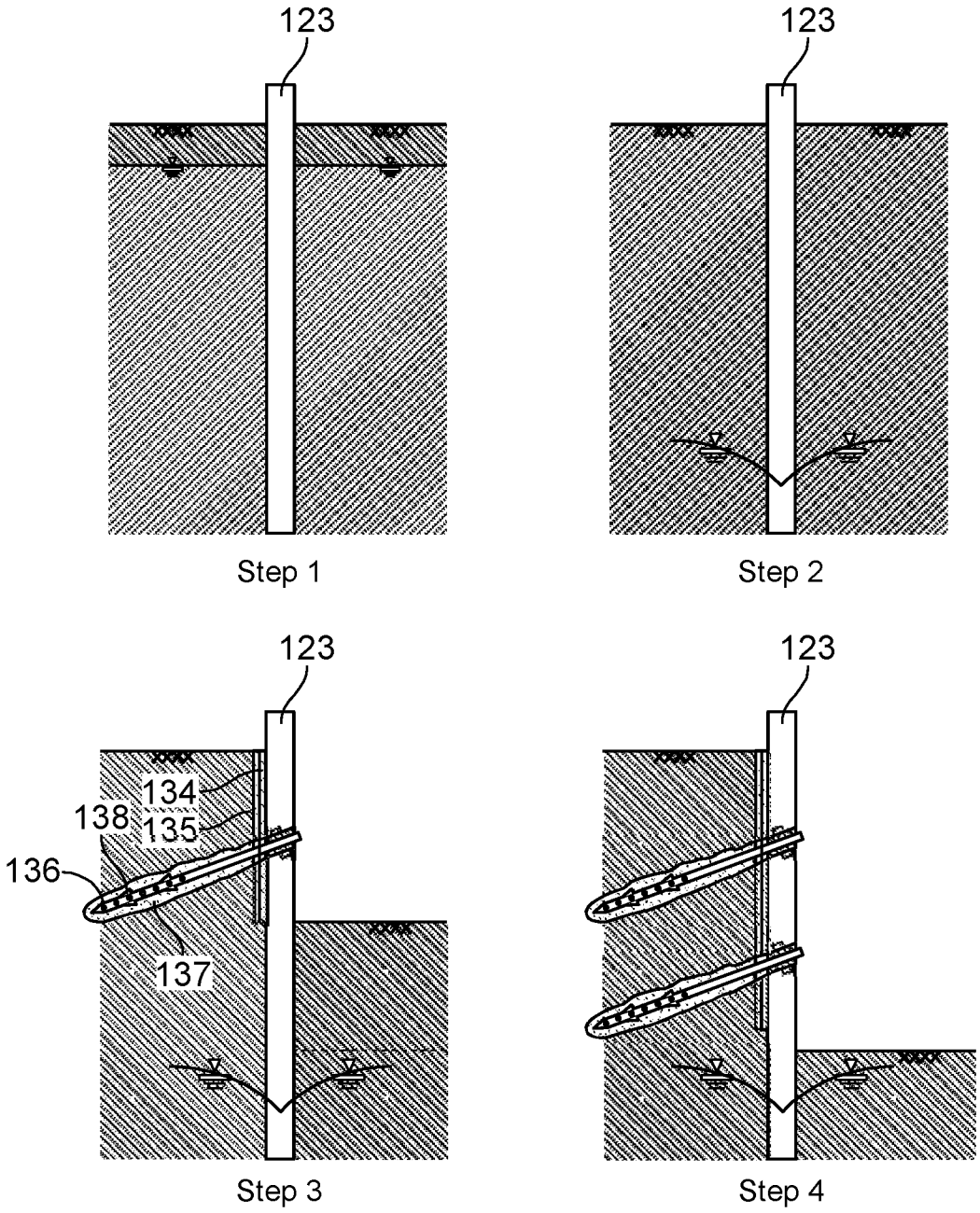
FIG. 6 illustrates schematic view of the cross section of the soil wall that is being stabilized with pipe nailing, according to an embodiment of the present invention.

FIG. 6 illustrates schematic view of the cross section of the soil wall that is being stabilized with pipe nailing, according to an implementation. The drainage pipe 127 fastened to the steel beam 123 is installed in the boundaries of the target location by the casing pipe 113. In one embodiment, a plurality of vertical steel beams 123 with drainage pipes 127 are installed in length 1.25-1.35 times the depth of excavated zone and with distance of 1.5-2.5 meter in excavated zone limitation by driving of steel casing pipe 113 with diameter of 20-25 centimeter using a special mandrel 115. After installation of well point, water is suctioned from the effective depth of the excavated zone 142. Then excavation is implemented at a depth of 1 to 2 m in the form of a column to a stable depth and insulating the drainage pipes 127. A welded mesh 134 is installed behind the steel vertical beam 123 and one or more layers of the shotcrete 135 with required thickness is provided on the wall of the target location. A steel grooved pipes 136 is hammered to cross of shotcrete layer 135 and welded mesh 134 into the target location under high frequency, wherein the steel grooved pipes 136 comprises a conical end and shear connections 138. The steel grooved pipes 136 comprises the grouted zone 137 around the nailing pipe 136. The steel grooved pipe 136 is fastened to the vertical beam 123 via at least two connections elements 139. The steel grooved pipe 136 crossing the shotcrete layer 135 and welded mesh 134 is sealed. Then the target location is dewatered using the drainage pipe 124 and stabilized the with the vertical beams 123 and nailed steel grooved pipes 136.

Figure 7:
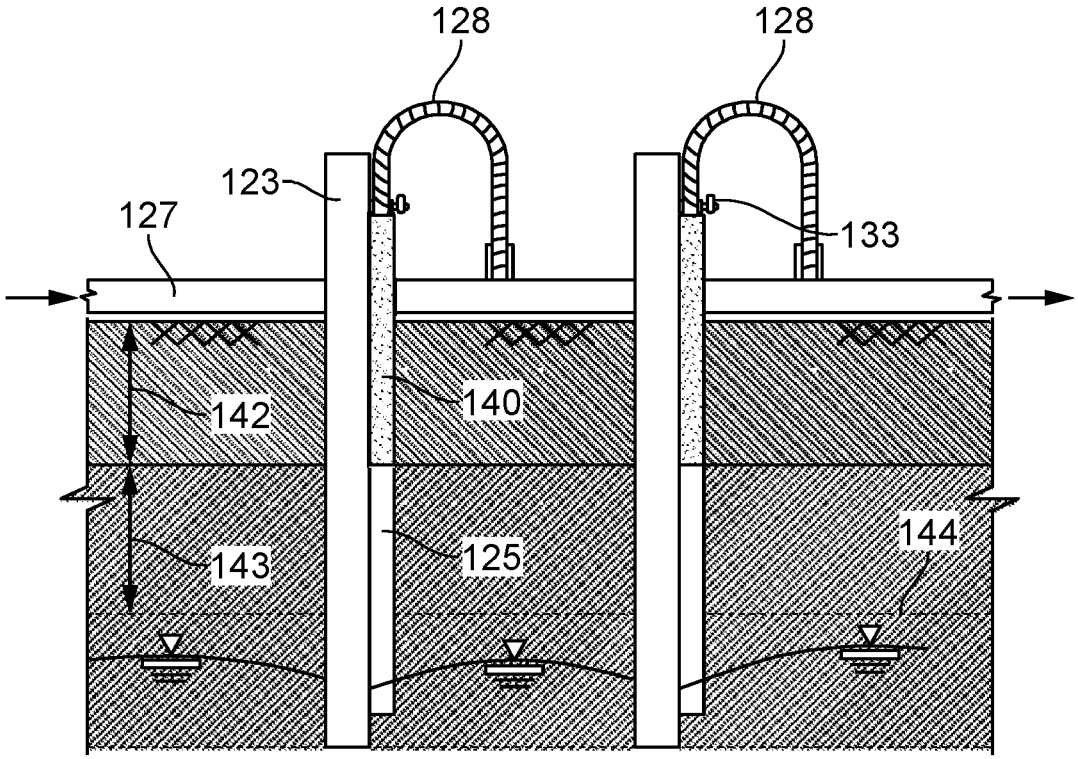
FIG. 7 illustrates schematic view of the cross section of excavated zone that is being dewatered by well point system and soil wall stabilized by structural beams and pipe nailing, respectively, according to an embodiment of the present invention.

FIG. 7 illustrates schematic view of the cross section of excavated zone 142 that is being dewatered by well point system and soil wall stabilized by structural beams 123 and pipe nailing, respectively, according to an implementation. In one embodiment, a method for constructing a retaining wall structure and a well point in granular soils under groundwater level is disclosed. The method comprises a step of: providing a hammering casing piping system. The method further comprises a step of: positioning the mandrel 115 above the target location. The method further comprises a step of: generating a cavity by driving the mandrel 115 using an external hydraulic hammer. The method further comprises a step of: removing the inner shaft assembly 115 from the casing 113 of the mandrel 115 positioned in the cavity. The method further comprises a step of: providing a vertical beam 123 and a drainage pipe 124 fastened to the vertical beam 123. The method further comprises a step of: inserting the drainage pipe 124 fastened to the vertical beam 123 into the casing 113 of the mandrel 115. The method further comprises a step of: removing the casing 113 from the target location. The method further comprises a step of: connecting the drainage pipe 124 to a horizontal pipe 127 connected with one or more water discharge pumps for lowering groundwater level. In the following, the unexcavated zone 143 is excavated and stabilized to the level of bottom of the foundation 144 in the same stage-to-stage process as in the above-mentioned.

The method further comprises a step of: installing a welded mesh 134 behind the vertical beam 123 and one or more layers of shotcrete layers 135 on the target location. The method further comprises a step of: hammering a steel grooved pipes 136 to cross of shotcrete layer 135 and welded mesh 134 into the target location under high frequency, wherein the steel grooved pipes 136 comprises a conical end and shear connections 138. The method further comprises a step of: sealing the steel grooved pipe 136 crossing the shotcrete layer 135 and welded mesh 134. The method further comprises a step of: dewatering the target location using the drainage pipe 124 and stabilizing the target location with the vertical beams 123 and nailed steel grooved pipes 136. The method further comprises a step of: spraying geofoam over the geotextile sheath 140 of the perforated polyethylene pipe in order to close all opening of perforated pipe after excavation.

The present disclosure is directed to a hammering casing pipe system for forming a cavity at a target location. The hammering casing pipe comprises a casing with a hollow cylindrical configuration having a first end and a second end comprising, at least two half-cylinders attached around the upper end of the casing for hardening the upper end, a steel ring disposed above the casing to harden and avoid bending of the casing, one or more vertical stiffener plates attached around the steel ring and the at least two half-cylinders, and at least one eye bar plate disposed at each half-cylinder. The hammering casing pipe further comprises an impact transmission shaft comprising an upper portion and a lower portion, a hammer element is coupled to the upper portion of the impact transmission shaft, wherein a diameter of the lower portion is greater than the upper portion.

In certain examples, the hammering pipe also includes an inner shaft disposed within the casing, the inner shaft comprises a top portion, a middle portion and a bottom portion, the middle portion and the lower portion are configured to insert within the casing, into the soil and prevents soil entering into the casing, wherein the top portion of the inner shaft comprises a mandrel head configured to transmit impact from the hammer element, a stepped cylindrical segment extends from the mandrel head configured to maintain the position of the inner shaft, a lower cylindrical segment extends from the stepped cylindrical segment having a diameter lesser than the stepped cylindrical segment, wherein the middle portion of the inner shaft comprises at least six guide triangular plates disposed around the middle portion of the inner shaft and at least six connector plates coupled to the at least six guide triangular plates, respectively, wherein the at least six guide triangular plates and the at least six connector plates are coupled to the lower cylindrical segment via an intermediate segment, and wherein the bottom portion of the inner shaft comprises a hollow cylindrical segment, a bevelled hollow cylindrical segment extending from the hollow cylindrical segment, and a conical segment extending from the bevelled hollow cylindrical segment configured to allow smooth penetration and prevention of soil entering into the casing pipe.

Another aspect of the present disclosure is directed to a hammering casing pipe system for forming a cavity at a target location, comprising a casing with a hollow cylindrical configuration having a first end and a second end comprising, at least two half-cylinders attached around the upper end of the casing for hardening the upper end, a steel ring disposed above the casing to harden and avoid bending of the casing, one or more vertical stiffener plates attached around the steel ring and the at least two half-cylinders, and at least one eye bar plate disposed at each half-cylinder. The casing pipe may further include an impact transmission shaft coupled to a hammer element; and an inner shaft disposed within the casing, the inner shaft comprises a top portion, a middle portion and a bottom portion, the middle portion and the lower portion are configured to insert within the casing, into the soil and prevents soil entering into the casing.

In certain examples, the casing pipe will be such that the top portion of the inner shaft comprises a mandrel head configured to transmit impact from the hammer element, a stepped cylindrical segment extends from the mandrel head configured to maintain the position of the inner shaft, a lower cylindrical segment extends from the stepped cylindrical segment having a diameter lesser than the stepped cylindrical segment, wherein the middle portion of the inner shaft comprises at least six guide triangular plates disposed around the middle portion of the inner shaft and at least six connector plates coupled to the at least six guide triangular plates, respectively, wherein the at least six guide triangular plates and the at least six connector plates are coupled to the lower cylindrical segment via an intermediate segment, and wherein the bottom portion of the inner shaft comprises a hollow cylindrical segment, a bevelled hollow cylindrical segment extending from the hollow cylindrical segment, and a conical segment extending from the bevelled hollow cylindrical segment configured to allow smooth penetration and prevention of soil entering into the casing pipe. The impact transmission shaft may comprise an upper portion and a lower portion. The diameter of the lower portion may be greater than the upper portion.

Certain features of the present disclosure are directed to a method for constructing retaining wall structure and well-point in granular soils under groundwater level. This method comprises providing a hammering casing pipe system. The hammering casing pipe system itself comprises a casing with a hollow cylindrical configuration having a first end and a second end comprising, at least two half-cylinders attached around the upper end of the casing for hardening the upper end, a steel ring disposed above the casing to harden and avoid bending of the casing, one or more vertical stiffener plates attached around the steel ring and the at least two half-cylinders, and at least one eye bar plate disposed at each half-cylinder; an impact transmission shaft coupled to a hammer element; and an inner shaft assembly disposed within the casing, the inner shaft comprises a top portion, a middle portion and a bottom portion, the middle portion and the lower portion are configured to insert within the casing, into the soil and prevents soil entering into the casing.

The casing pipe system is such that the top portion of the inner shaft comprises a mandrel head configured to transmit impact from the hammer element, a stepped cylindrical segment extends from the mandrel head configured to maintain the position of the inner shaft, a lower cylindrical segment extends from the stepped cylindrical segment having a diameter lesser than the stepped cylindrical segment, wherein the middle portion of the inner shaft comprises at least six guide triangular plates disposed around the middle portion of the inner shaft and at least six connector plates coupled to the at least six guide triangular plates, respectively, wherein the at least six guide triangular plates and the at least six connector plates are coupled to the lower cylindrical segment via an intermediate segment, and wherein the bottom portion of the inner shaft comprises a hollow cylindrical segment, a bevelled hollow cylindrical segment extending from the hollow cylindrical segment, and a conical segment extending from the bevelled hollow cylindrical segment configured to allow smooth penetration and prevention of soil entering into the casing pipe.

The method may further include positioning the hammering casing pipe system above the target location; generating a cavity by driving the casing using an external hammer element; removing the inner shaft from the casing positioned in the cavity; providing a vertical beam and a drainage pipe fastened to the vertical beam; inserting the drainage pipe fastened to the vertical beam into the casing; removing the casing from the target location; connecting the drainage pipe to a horizontal pipe connected with one or more water discharge pumps for lowering groundwater level.

The method may further include installing a welded mesh behind the vertical beam and one or more shotcrete layers on the target location; hammering one or more steel grooved pipes to cross of shotcrete layer and welded mesh into the target location under high frequency; sealing the steel grooved pipe crossing the shotcrete layer and welded mesh, and dewatering the target location using the drainage pipe and stabilizing the target location with the vertical beams and nailed steel grooved pipes.

The advantages of excavation process in granular loose soils with high groundwater level are as follows: (a) in the conditions of existence loose soil layers and high groundwater level, it is possible to install thin steel beams and steel vertical pipes in the boundaries of the desired land by installing temporary casing pipe without removing the soil, (b) this method of installing vertical drainage pipes, prevents the piping of sand into the drainage pipe through the end of it, (c) non-obstruction of the filters installed at the ends of the water-absorbing pipes inside the drainage pipes during the construction period of the excavation area, (d) possibility of installing a special drainage system for drying the excavation area consisting of vertical drainage pipes near steel beams and no change in the position of the drainage system is required until end of the excavation work, (e) implementation of composite retaining wall structure consists of, I-shape steel beams, steel welded mesh located in intermediate of soil wall and steel beams, shotcrete layer from soil wall surface to steel beam flange and rammed-injected soil nailing in vertical horizontal defined spaces, and minimizing the perimeter wall thickness by using I-shape steel beams at least 15 cm.

Additional advantages include (f) full protection of drainage pipes against the fracture and damage of plastic pipes due to the adjacency of these pipes with steel slabs and the phase burial of these pipes in the shotcrete layer during construction, (g) in case of a hard intermediate layer with low permeability, water drainage is done through the effective depth of excavated zone (1.25-1.35 times of the depth of excavated zone) and in upper and lower parts of this hard intermediate by installing drainage pipes near steel beams, and it is possible to installing thin steel beams and vertical drainage pipes by this design of the mandrel system, (h) enables quick installation of each steel beams and vertical drainage pipes, within 15 minutes, (i) by using geotextile layer around the grooved plastic pipe, there is no need of gravel filter round vertical drainage pipes, (j) use of conventional mechanical excavator to installation steel beams and vertical drainage pipes and rammed nailing, and avoids the usage of heavy and bulk machines (devices) due to the low area of urban lands, low passageways, existence of urban facilities such as, power lines and telecommunications, (j) simple in construction and operation and inexpensive and (k) ease in implementation of this system is possible with the higher degree of safety, speed and quality. The application of the present invention is; but not limited to, in the construction of buildings that having basement and underground tanks or reservoirs of water, fuel and chemical products, etc. The highest potential for deploying this invention is in coastal areas with sandy soils and high groundwater levels.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims.

The invention claimed is:

1. A method for constructing retaining wall structure and wellpoint in granular soils under groundwater level, comprising the steps of:

providing a hammering casing pipe system comprising, a casing with a hollow cylindrical configuration having a first end and a second end comprising, at least two half-cylinders attached around an upper end of the casing for hardening the upper end, a steel ring disposed above the casing to harden and avoid bending of the casing, one or more vertical stiffener plates attached around the steel ring and the at least two half-cylinders, and at least one eye bar plate disposed at each half-cylinder, an impact transmission shaft coupled to a hammer element, and an inner shaft assembly disposed within the casing, the inner shaft assembly comprises a top portion, a middle portion and a bottom portion, the middle portion and the bottom portion are configured to insert within the casing, into the soil and prevents soil entering into the casing, the top portion of the inner shaft assembly comprises a mandrel head configured to transmit impact from the hammer element, a stepped cylindrical segment extends from the mandrel head configured to maintain a position of the inner shaft assembly, a lower cylindrical segment extends from the stepped cylindrical segment, the lower cylindrical segment having a diameter lesser than a diameter of the stepped cylindrical segment, the middle portion of the inner shaft assembly comprises at least six guide triangular plates disposed around the middle portion of the inner shaft assembly and at least six connector plates coupled to the at least six guide triangular plates, respectively, wherein the at least six guide triangular plates and the at least six connector plates are coupled to the lower cylindrical segment via an intermediate segment, and the bottom portion of the inner shaft assembly comprises a hollow cylindrical segment, a bevelled hollow cylindrical segment extending from the hollow cylindrical segment, and a conical segment extending from the bevelled hollow cylindrical segment configured to allow smooth penetration and prevention of soil entering into the casing pipe;

positioning the hammering casing pipe system above a target location;

generating a cavity by driving the casing using an external hammer element;

removing the inner shaft assembly from the casing positioned in the cavity;

providing a vertical beam and a drainage pipe fastened to the vertical beam;

inserting the drainage pipe fastened to the vertical beam into the casing;

removing the casing from the target location;

connecting the drainage pipe to a horizontal pipe connected with one or more water discharge pumps for lowering groundwater level;

installing a welded mesh behind the vertical beam and one or more shotcrete layers on the target location;

hammering one or more steel grooved pipes to a cross formed of a shotcrete layer and welded mesh, the hammering occurring at a target location under high frequency;

sealing a steel grooved pipe crossing the shotcrete layer and welded mesh, and dewatering the target location using the drainage pipe and stabilizing the target location with the vertical beams and nailed steel grooved pipes.

2. The method of claim 1, wherein the steel grooved pipes comprises a conical end and shear connections.

3. The method of claim 1, wherein the drainage pipe is polyethylene perforated drainage pipe.

4. The method of claim 1, wherein an outer surface of the drainage pipe comprises a geotextile sheath.

5. The method of claim 1, further comprises a step of spraying geofoam over a geotextile sheath of a perforated polyethylene pipe in order to close all opening of perforated pipe after excavation.

6. The method of claim 1, wherein a bottom end of the drainage pipe comprises a filter material.

* * * * *